US005537801A

United States Patent [19]

Granbakken et al.

[11] Patent Number: 5,537,801

[45] Date of Patent: Jul. 23, 1996

[54] APPARATUS AND METHOD FOR MOUNTING CARRYING STRIPS ON BOTTLES

[75] Inventors: Tore Granbakken; Erik H. Skogly, both of Darbu, Norway

[73] Assignee: Norpapp Industri AS, Norway

[21] Appl. No.: 256,456

[22] PCT Filed: Jan. 13, 1993

[86] PCT No.: PCT/NO93/00009

§ 371 Date: Sep. 23, 1994

§ 102(e) Date: Sep. 23, 1994

[87] PCT Pub. No.: WO93/13987

PCT Pub. Date: Jul. 22, 1993

[30] Foreign Application Priority Data

Jan. 14, 1992 [NO] Norway ..... 920171

[51] Int. Cl.[6] ..... B65B 17/02; B65B 21/00; B65B 27/04

[52] U.S. Cl. ..... 53/398; 53/413; 53/48.1; 53/134.1

[58] Field of Search ..... 53/48.1, 398, 413, 53/134.1

[56] References Cited

U.S. PATENT DOCUMENTS

| | | | |
|---|---|---|---|
| 2,873,565 | 2/1959 | Arneson | 53/398 |
| 3,094,210 | 6/1963 | Van Den Berg | 53/48.1 |
| 3,302,364 | 2/1967 | Rice | 53/48.1 X |
| 3,760,554 | 9/1973 | Arneson | 53/398 |
| 4,121,401 | 10/1978 | Duerr et al. | 53/398 |
| 4,213,283 | 7/1980 | Calvert et al. | 53/48.1 |
| 4,848,061 | 7/1989 | Le Bras | 53/398 |
| 5,099,632 | 3/1992 | Klygis et al. | 53/398 |
| 5,184,448 | 2/1993 | Kazlauskas | 53/398 |

FOREIGN PATENT DOCUMENTS

0460341B1 6/1994 European Pat. Off. .

*Primary Examiner*—Horace M. Culver
*Attorney, Agent, or Firm*—Pollock, Vande Sande & Priddy

[57] ABSTRACT

An apparatus for mounting carrying strips on a plurality of bottles, characterized in that the apparatus comprises a cardboard blank magazine having a number of interconnected vertical rods (1) adapted to be thrust down into perforated holes stamped out in the carrying strip, an extraction means (2) that draws the carrying strips out of the cardboard blank magazine and transfers them to a folding device, which folding device comprises a side folder (3) designed such that the side flaps of the carrying strip are folded up when the cardboard blank is pressed against a complementarily shaped mold (5), there being provided in the bottom of the side folder (3) a plurality of pointed members (4) that pre-bend/pierce the holes for the bottles, and top folders (*6a, 6b*) that fold the top flaps around the mold (5), a contraction device (8) that conducts the ready-folded carrying strips sideways into a top flap holder (7), a push-out device (9) that presses the ready-folded carrying strips out of the mold (5) and into a set of hinged carrier flaps (10) in a pressure station, and a depressor plate (11) that presses the carrying strips down onto the bottles. There is also described a method for mounting carrying strips.

4 Claims, 2 Drawing Sheets

APPARATUS AND METHOD FOR MOUNTING CARRYING STRIPS ON BOTTLES

Figure 1:
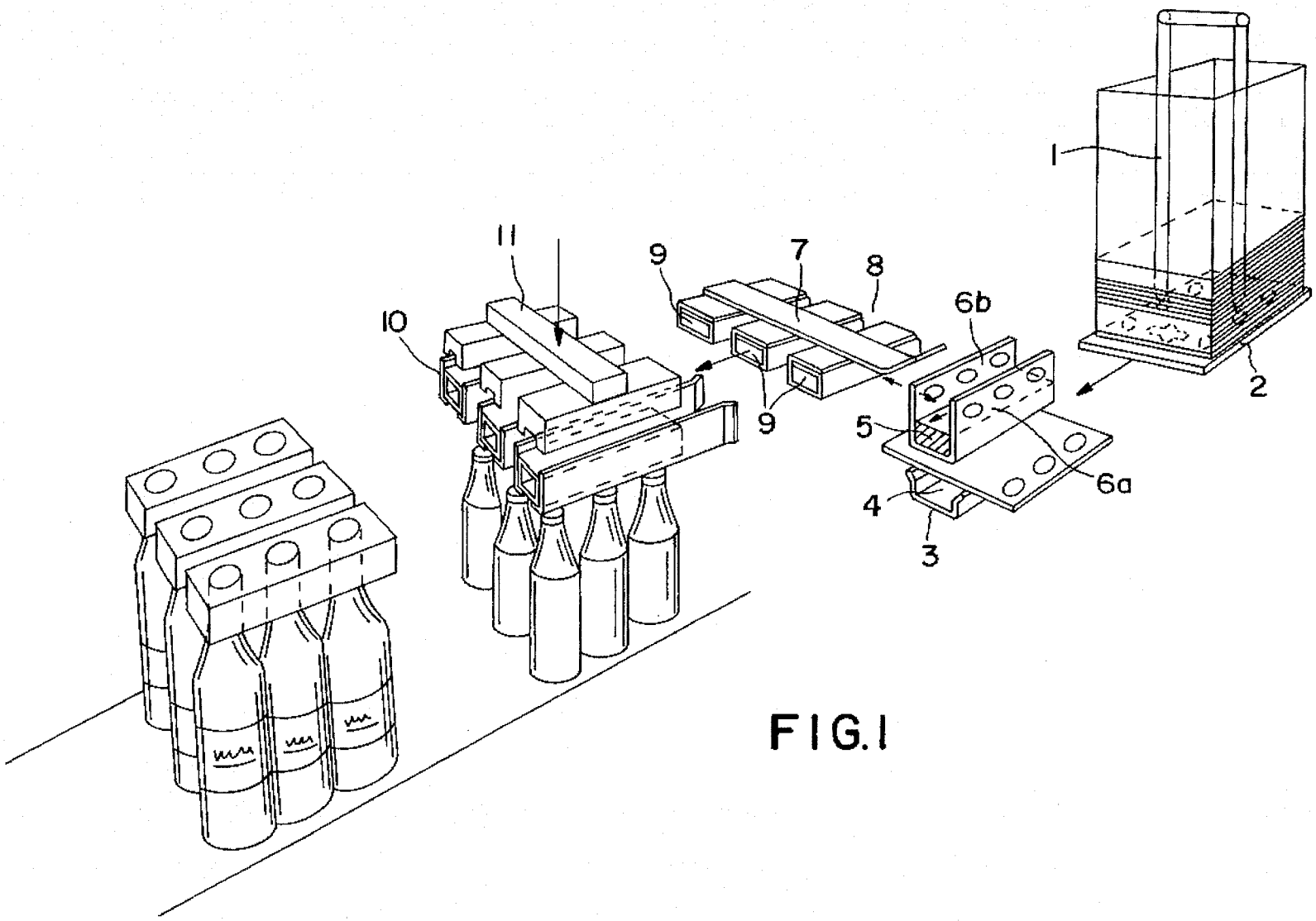

The present invention relates to an apparatus and method for mounting carrying strips on bottles.

From Norwegian patent no. 166.852 is known a carrying device for a plurality of capped bottles consisting of a foldable sheet material in the form of a rectangular plate or strip folded into a case having a quadrilateral cross-section, where in two sides of the case arranged one above the other a plurality of holes are provided for the bottle necks.

Similar carrying devices for a plurality of bottles are also known from U.S. Pat. No. 2,299,525 and Norwegian Patent 165,721, which corresponds to European Patent No. 0 460 341.

Beer and soft drinks are usually stored and transported in cases. Often, however, it is of interest to make a special sale offer on a number of bottles. These are then attached to a common carrying handle, so that the customer may take with him the quantity to which the sale applies, and the handle with the specific number of bottles then constitutes a portable unit.

Carrying plates or strips of the aforementioned type are usually mounted manually on bottles standing in cases. There is a known device for automatic application of carrying strips with space for 6 bottles in a 2×3 configuration. This device, however, functions according to a different principle than the apparatus in accordance with the invention. Hence, the known device is built with an entirely different construction, causing it to be disproportionately expensive. The carrying strips that may be used in the present invention are of a type which does not require gluing—a process which makes the production of the carrying strips considerably more expensive. The carrying strips to be used in the invention are thus self-locking when mounted on the bottles.

With an apparatus in accordance with the invention, the carrying strips are fitted over the bottle necks and pressed into place in one simple operation, whereas with the known device this is done in two separate operations. The known device is constructed for only a specific type of bottle in a 3×2 configuration.

With the exception of this one device of the aforementioned type, all mounting of carrying strips is done manually. This is a very time-consuming, difficult and expensive operation. Nor does the inventor know of any devices for automatic application of carrying strips where the bottles are placed successively in a row in carrying strips.

The principle of the present invention allows the apparatus for mounting carrying strips on bottles to have a very simple construction, making it both reasonable to procure, simple to use and capable of working with a large capacity. The apparatus is relatively small and is easy to adapt to a continuous production process.

The invention comprises an apparatus for mounting carrying strips on a plurality of bottles, which is characterized in that it comprises a cardboard blank magazine having a number of interconnected vertical rods adapted to be thrust down into perforated holes stamped out in the carrying strip, an extraction means that draws the carrying strips out of the cardboard blank magazine and transfers them to a folding device, which folding device comprises a side folder designed such that the side flaps of the carrying strip are folded up when the cardboard blank is pressed against a complementarily shaped mold, there being provided in the bottom of the side fielder a plurality of pointed members that pre-bend or pierce the holes for the bottles, and top folders that fold the top flaps around the mold, a contraction device that conducts the ready-folded carrying strips sideways into a top flap holder, a push-out device that presses the ready-folded carrying strips out of the mold and into a set of hinged carrier flaps in a pressure station, and a depressor plate that presses the carrying strips down onto the bottles.

In large capacity production, a mid-station is employed prior to the pressure station.

The contraction device comprises a means for bringing a plurality of the folded carrying strips into a position corresponding to the placement of the bottles on the conveyor system.

The invention also comprises a method of mounting carrying strips on a plurality of bottles, which is characterized by its comprising the following steps:

a) placing non-folded carrying strips in a cardboard blank magazine having a number of interconnected vertical rods adapted to be thrust down into perforated holes stamped out in the carrying strips, b) transferring the carrying strips individually from the cardboard blank magazine to a folding device with the aid of an extraction means, c) folding up the side flaps of the carrying strips by pressing said strips down into a side folder with the aid of a complementarily shaped mold, and simultaneously pre-bending/piercing the holes for the bottles with the aid of a plurality of pointed members provided in the bottom of the side folder, d) folding the top flaps of the carrying strips around the mold with the aid of top folders, e) conducting the ready-folded carrying strips sideways with a contraction device into a top flap holder, f) Pushing the ready-folded carrying strips out of the mold with the aid of a push-out device into a set of hinged carrier flaps in a pressure station, if desired via a mid-station, g) pressing the ready-folded carrying strips down onto the bottles with the aid of a depressor plate.

A plurality of ready-folded carrying strips are arranged with the aid of a contraction device into positions corresponding to the position of the bottles on the conveyor system. The invention may also be adapted to a plurality of bottles in a row, which is later cut up into the desired number (2-pack, 3-pack, 4-pack, etc.).

The invention will be explained further in the following with the aid of an embodiment example and with reference to the accompanying drawings, FIG. 1 is a schematic view of the method for mounting carrying strips in accordance with the invention.

Figure 2:
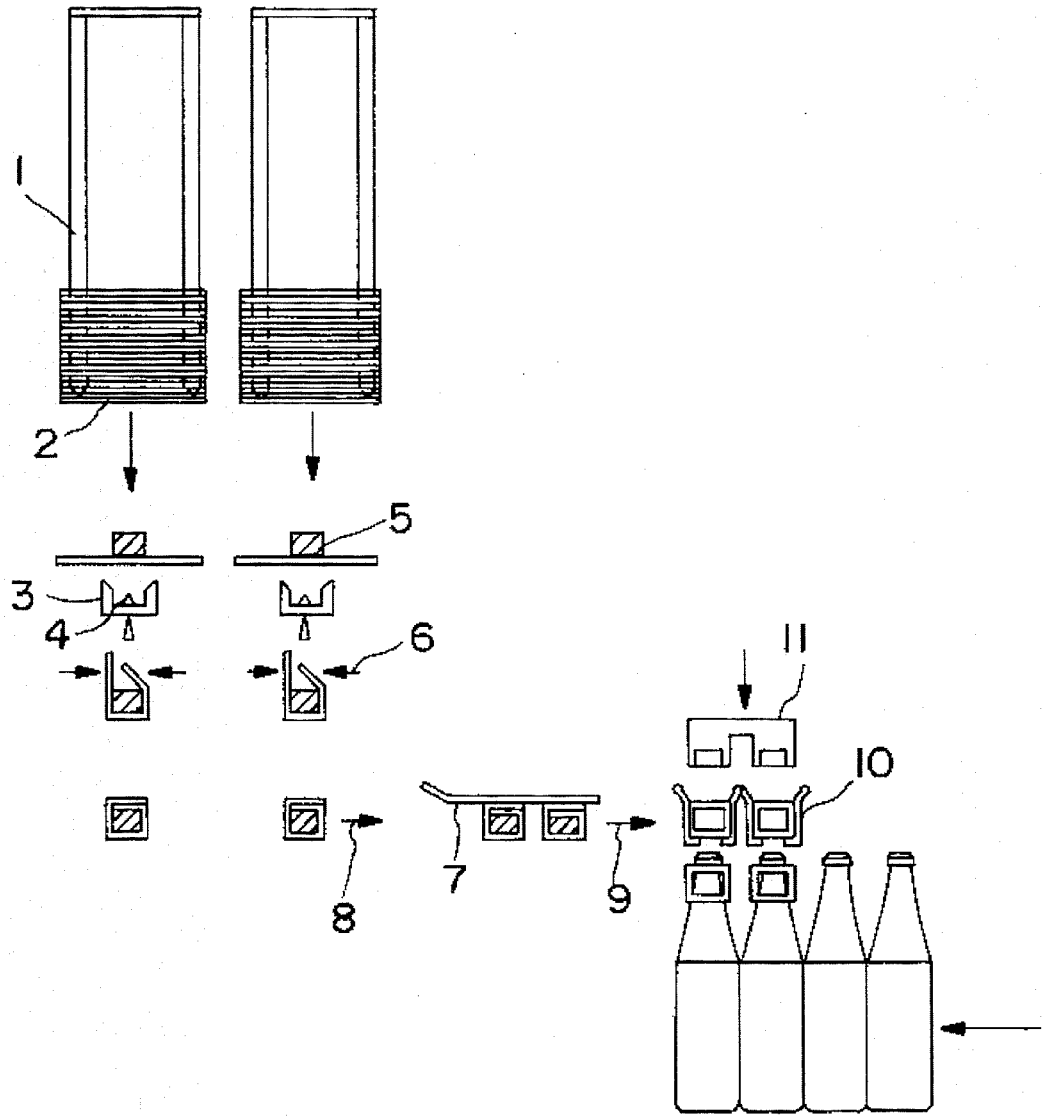

FIG. 2 is a view showing handling and folding of the carrying strip by the method in accordance with the invention.

The carrying strip in flat state is placed in the cardboard magazine in the machine with the aid of two interconnected rods (1) which are thrust down into perforated holes stamped out in the carrying strips. The rods (1) function both as fetching implements and as cardboard steering means in the magazine.

An extraction system (2) feeds the carrying strip into a folding system.

A side folder (3) presses the blank against a mold (5). This side folder (3) is shaped such that the side flaps of the carrying strip are folded up. Simultaneously, holes for the bottles are pre-bent/pierced by pressing up a "point" (4).

A top folding device (*6a*, *6b*) folds the top flaps together around the mold (5).

A contraction device (8) conducts the ready-folded carrying strips sideways (the number determined by preference and by packaging design) to attain the correct center spacing between the bottles. An overlying top flap holder (7) holds the top flaps in place.

A push-out device (9) presses the ready-folded carrying strips out of the mold (5) and into a set of hinged carrier flaps (10) in a pressure station.

The bottles are then conducted in under the pressure station on a conveyor system (not shown) (alternatively, via a mid-station).

When a desired number of bottles are in position, a depressor plate (11) having an opening for the bottle tops presses the carrying strips down onto the bottles and the carrier flaps (10) open. The bottles may then be transported further with the carrying strips mounted thereon.

It is readily apparent to a person skilled in the art that changes and modifications may be made in the apparatus and method described above. For example, there may be used carrying strips having space for a different number of bottles than that shown in the embodiment example in FIGS. 1 and 2. The invention may also be used for mounting carrying strips where the bottles are lined up in a row, instead of being place alongside one another.

We claim:

1. An apparatus for mounting carrying strips having top and side flaps on a plurality of bottles comprising:

(a) cardboard blank magazine having a plurality of interconnected vertical rods (1) adapted to be thrust down into perforated holes in the carrying strip;

(b) an extraction means (2), whereby said extraction means (2) draws the carrying strips out of the cardboard blank magazine and transfers them to a folding device;

(c) the folding device of (b) for the production of ready-folded carrying strips comprising:

(i) a side folder (3) for folding up the side flaps of the carrying strip when the cardboard blank is pressed against a complementary shaped mold (5), (ii) a plurality of pointed members (4) at the bottom of the side folder (3) for pre-bending or piercing holes for the bottles, and (iii) top folders (*6a*, *6b*) for folding the top flaps around the mold (5);

(d) a contracting device (8);

(e) a top flap holder (7), whereby the contracting device (8) conducts the ready-folded carrying strips sideways into the top flap holder (7);

(f) a push-out device (9);

(g) a set of hinged carrier flaps (10), whereby the push-out device (9) presses the ready folded carrying strips out of the mold (5) into the set of hinged carrier flaps (10) in a pressure station; and (h) a depressor plate (11) for pressing the carrying strips down onto the bottles.

2. The apparatus of claim 1 further characterized in that the contraction device (8) comprises a means by which the plurality of the folded carrying strips are positioned corresponding to the bottles placed on a conveyor system.

3. A method for mounting carrying strips having top and side flaps on a plurality of bottles, which comprises the following steps:

(a) placing non-folded carrying strips in a cardboard blank magazine (1) having a number of interconnected vertical rods to be trust down into perforated holes in the carrying strips;

(b) transferring the carrying strips individually from the cardboard blank magazine (1) to a folding device using an extraction means (2);

(c) folding up the side flaps of the carrying strips by pressing said strips down into a side folder (3) with the aid of a complementarily shaped mold (5), and simultaneously pre-bending or piercing holes for the bottles using a plurality of pointed members (4) at the bottom of the side folder (3);

(d) folding the top flaps of the carrying strips around the mold (5) with the aid of top folders (*6a*, *6b*), whereby ready-folded carrying strips are produced;

(e) conducting the ready-folded carrying strips of (d) sideways by means of a contraction device (8) into a top flap holder (7);

(f) pushing the ready-folded carrying strips out of the mold (5) with the aid of a push-out device (9) into a set of hinged carrier flaps (10) in a pressure station, if desired via a mid-station;

(g) pressing the ready-folded carrying strips down onto the bottles with the aid of a depressor plate (11).

4. The method of claim 3, whereby the contraction device (8) positions a plurality of ready-folded carrying strips corresponding to the bottles placed on a conveyor system.

* * * * *